US007788997B2

(12) United States Patent
Kozak et al.

(10) Patent No.: US 7,788,997 B2
(45) Date of Patent: Sep. 7, 2010

(54) MAGNETIC DEVICE FOR HOLDING AND DRIVING BITS AND FASTENERS

(75) Inventors: Burton Kozak, Chicago, IL (US); Ira Kozak, Chicago, IL (US)

(73) Assignee: Combined Products Co., #1, Inc., Chicago, IL (US)

( * ) Notice: Subject to any disclaimer, the term of this patent is extended or adjusted under 35 U.S.C. 154(b) by 577 days.

(21) Appl. No.: 11/400,756

(22) Filed: Apr. 7, 2006

(65) Prior Publication Data

US 2007/0234857 A1 Oct. 11, 2007
US 2008/0041195 A9 Feb. 21, 2008

Related U.S. Application Data

(60) Provisional application No. 60/669,698, filed on Apr. 8, 2005.

(51) Int. Cl.
*B25B 23/12* (2006.01)

(52) U.S. Cl. ..... 81/451

(58) Field of Classification Search ..... 81/436, 81/442, 451; 7/165, 901
See application file for complete search history.

(56) References Cited

U.S. PATENT DOCUMENTS 3,392,767 A * 7/1968 Stillwagon, Jr. ..... 81/451
5,259,278 A 11/1993 Leas
5,544,555 A 8/1996 Corley
5,603,248 A 2/1997 Eggert
5,724,873 A * 3/1998 Hillinger ..... 81/451
5,794,497 A * 8/1998 Anderson ..... 81/451
5,861,789 A 1/1999 Bundy
6,499,168 B1 * 12/2002 Anderson ..... 7/165
6,668,689 B1 12/2003 Lai
RE38,778 E * 8/2005 Eggert et al. ..... 81/439
2005/0013674 A1 1/2005 Vidal

FOREIGN PATENT DOCUMENTS

DE 92 14 551 U1 5/1993
DE 94 15 879 B1 11/1994
DE 295 10 44 U1 9/1995
EP 0 827 812 A 3/1998
WO WO 2004/082893 A 9/2004

OTHER PUBLICATIONS

European Search Report No. EP 1710050 published Feb. 25, 2009.

* cited by examiner

*Primary Examiner*—Hadi Shakeri
(74) *Attorney, Agent, or Firm*—Factor & Lake, Ltd.

(57) ABSTRACT

A tool is provided for slidably receiving, magnetically holding, and mechanically engaging fasteners, tool bits, and nuts. The tool comprises one or more magnetic annuluses in stacked relation to each other. The tool defines an inner periphery that matches the shape of the fastener, bit, or nut. The tool further comprises an outer periphery adapted to be grasped by a hand or a tool so that a mechanical torque applied to the outer periphery of the annulus, which results in a mechanical torque applied to the fastener, bit, or nut.

8 Claims, 8 Drawing Sheets

MAGNETIC DEVICE FOR HOLDING AND DRIVING BITS AND FASTENERS

This utility application claims the benefit of U.S. Provisional Patent Application No. 60/669,698, filed on Apr. 8, 2005.

FIELD OF THE INVENTION

The present invention relates to the field of tools and tool bits and more specifically, the present invention relates to the field of hand-held tools that utilize a magnetic force to hold tool bits, fasteners, and nuts.

BACKGROUND OF THE INVENTION

A bane of existence for many tradesman is separation of screw head or other fastener from a screwdriver tip or other bit during screw installation. Many tools use magnetization to hold a tool bit and a fastener together during driving operations. A typical arrangement is where a magnet is positioned near to or at the driving end of a screw driver's shank. The magnet imparts a magnetization to the tool bit which in turn attracts a ferrous fastener, such as a metal screw. The magnet is often lodged in a socket or a chuck at the tip of the shank; see for instance, U.S. Pat. No. 5,941,139 (Vodehnal); U.S. Pat. No. 5,913,596 (Lin); and U.S. Pat. No. 5,603,248 (Eggert et. al).

These designs have the disadvantage of being expensive to produce and cumbersome to use, especially in tight places. Moreover, the device must be discarded as a whole (magnet, bit, and handle) when, after repeated usage, the magnet loses its strength. Finally, typical tool configurations do not capture a major fraction of the magnetization force of the magnet.

Another design is where a magnetic ring or donut with a circular inner bore is slidably received by the tool shank and positioned at a point intermediate between the handle of the tool and the socket or chuck at the driving end. Such a design is disclosed in U.S. Pat. No. 5,861,789 (Bundy et al.) where a magnetic ring with a circular inside bore is slid over the working end of a screw driver to come to rest along the shank of the tool. This arrangement is cumbersome and bulky inasmuch as it requires the rink to be positioned precisely along a tool shank to confer magnetization to the bit. The ring is also positioned proximal to the handle and intermediate the handle and the bit. As a result of this positioning, full strength of the magnet is seldom available to effect the tool bit or the fastener driven by the bit.

Thus, there is a need in the art for a magnetic bit- or fastener- or nut-holding device that is both compact and economical to produce and to use. The device should utilize the full strength of a magnet to hold the bit and/or a fastener or a nut at the tip of the bit. The device should also provide mechanical means for imparting torque to the bit and/or to the fastener.

SUMMARY OF THE INVENTION

An object of the present invention is to provide a tool for holding and using tool bits, fasteners, and nuts that overcomes the disadvantages in the prior art.

Another object of the present invention is to provide a compact magnetic bit holder that can be used as a fastener driver. A feature of the present invention is a magnetized annulus defining an aperture which is adapted to slidably receive a tool bit, a tool shank, or a fastener so as to impart magnetic and mechanical force thereto. An advantage of the present invention is that it allows the direct application of magnetic force to a bit or fastener with or without the application of mechanical force to the bit or fastener. A further advantage of the present invention is that the magnetic ring may be used as a removable handle for a bit or fastener.

Still another object of the present invention is to provide a magnetic bit, fastener, or nut holder with variable magnetic strength A feature of the present invention is that magnetic rings can be stacked coaxially. An advantage of the present invention is that the available magnetic field can be increased as needed. Another advantage is that coaxial stacking enlarges the exterior-facing surface of the handle to which a mechanical torque-imparting tool (such as a wrench) can be applied.

Yet another object of the present invention is to provide a magnetic bit, fastener, or nut holding device that allows for quick interchange of tool bits, fasteners, or nuts. A feature of the present invention is that the device is adapted to slidably receive tool shanks, bits, or fasteners (such as screws, bolts or nuts). An advantage of the present invention is that the bits, fasteners, or nuts can be easily inserted or removed from the device in a one-hand operation.

A further object of the present invention is to provide a bit, fastener, or nut holder that allows the use of a wrench or a pair of pliers for turning the bit, fastener, or nut. A feature of the present invention is that the magnetic rings have a non-circular outer periphery. An advantage of the present invention is that a wrench may be used to impart greater torque than is capable with bare hands.

Yet a further object of the present invention is to provide a bit-turning device that may be used as a holder for a threaded fastener or nut. A feature of the present invention is that the holder is adapted to simultaneously magnetically hold and mechanically turn the threaded fastener or nut. Another feature of the device is that magnetic force can be applied to the bit or fastener without imparting mechanical (e.g. rotational) force to the bit or fastener. An advantage of the present invention is that the integration of magnetic and mechanical features into one device renders the device more compact.

Yet another object of the present invention is to provide a magnetic accessory for a variety of tools. A feature of the present invention is a magnetic annulus that can be attached by means of a set screw, friction, magnetic attraction, or otherwise to a tool that is inserted through its cavity. An advantage of the present invention is that the magnetic field of the annulus can capture metal shavings and debris. Another advantage of the use of the present invention in this configuration is that it can be used as a drill stop to limit the depth penetration of the tool into a workpiece.

In brief, this invention generally discloses a device adapted to slidably receive a first object having a predetermined cross section, the device defining an annulus comprising an inner periphery having a configuration that is complementary to the geometry of said cross section of the first object; an outer periphery adapted to allow manipulation so as impart a mechanical torque to the first object; and means to magnetically hold the first object and to attract a second object. Specifically, the first object may be, inter alia, any of the following: a bit, a fastener, or a nut. Where the first object is a bit, the second object may be a fastener or a nut. Thus the present invention offers an economical and sturdy device for magnetically holding and mechanically driving tool bits, fasteners, and threaded nuts. The device comprises one or more stackable magnetic rings or annuluses defining a non-uniform external periphery and an inner cavity adapted to mechanically (i.e., frictionally engage) and magnetically hold a tool bit, a fastener, or a threaded nut such that the magnetic ring (or rings) can be used as a tool handle or can be grasped by a wrench, pliers, a chuck, or the like.

BRIEF DESCRIPTION OF THE DRAWING

The invention together with the above and other objects and advantages will best be understood from the following detailed description of the preferred embodiment of the invention shown in the accompanying drawing, wherein.

DETAILED DESCRIPTION OF THE INVENTION

The present invention provides for the magnetic holding and mechanical rotation of objects such as tool bits or threaded fasteners or nuts by means of magnetic rings or annuluses. The objects (tool bits, fasteners, nuts, etc. . . .) are slidably held in central cavities defined by the annuluses. The cross section configuration of the central cavities match those of the objects with which the annuluses are in slidable communication.

The invented devices are adapted to be coaxially stacked together so as to provide a construct defining an axial bore or channel. One of the openings to the bore may be capped (as depicted in FIG. 1), thus preventing the objects inside the cavities from extending entirely through the construct.

The peripheries of the rings (i.e. the outwardly-facing surfaces of the rings) define surface topographies (for example flutes) to facilitate rotatable manipulation of the device by fingers or by tools such as plyers, wrenches or chucks of power drivers. For the sake of brevity, the following description will emphasize the use of the invention in conjunction with the engagement and rotation of tool bits.

When used as the handle of a tool, the proposed magnetic bit-holder transforms an assortment of bits into an assortment of magnetized fastener drivers. Furthermore, the invented bit, fastener, or nut holder can impart mechanical torque to bits that are not magnetizable.

Figure 1:
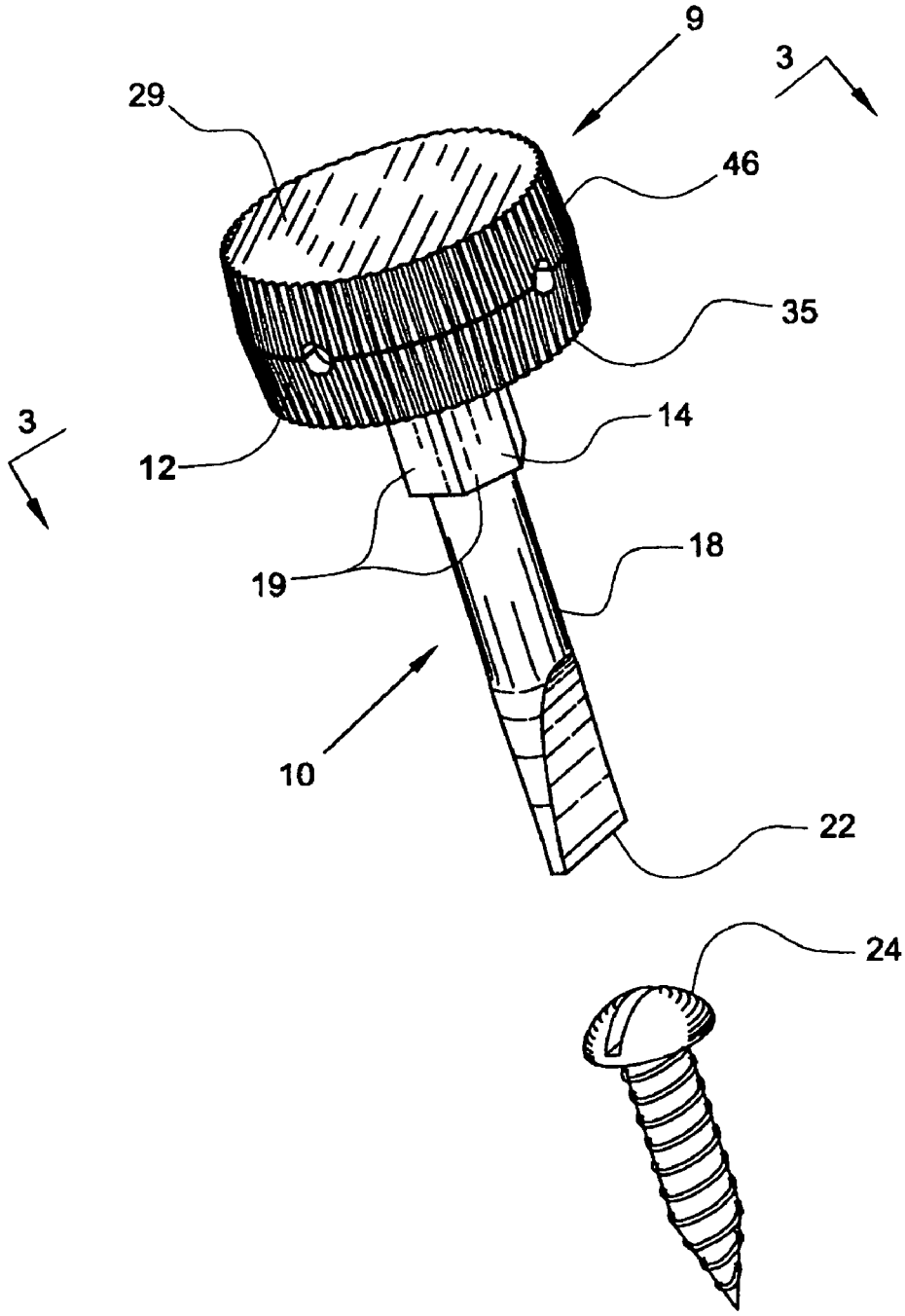
FIG. 1 is a perspective view of a magnetic bit-holding tool in combination with a bit and a fastener, in accordance with features of the present invention.
Figure 2:
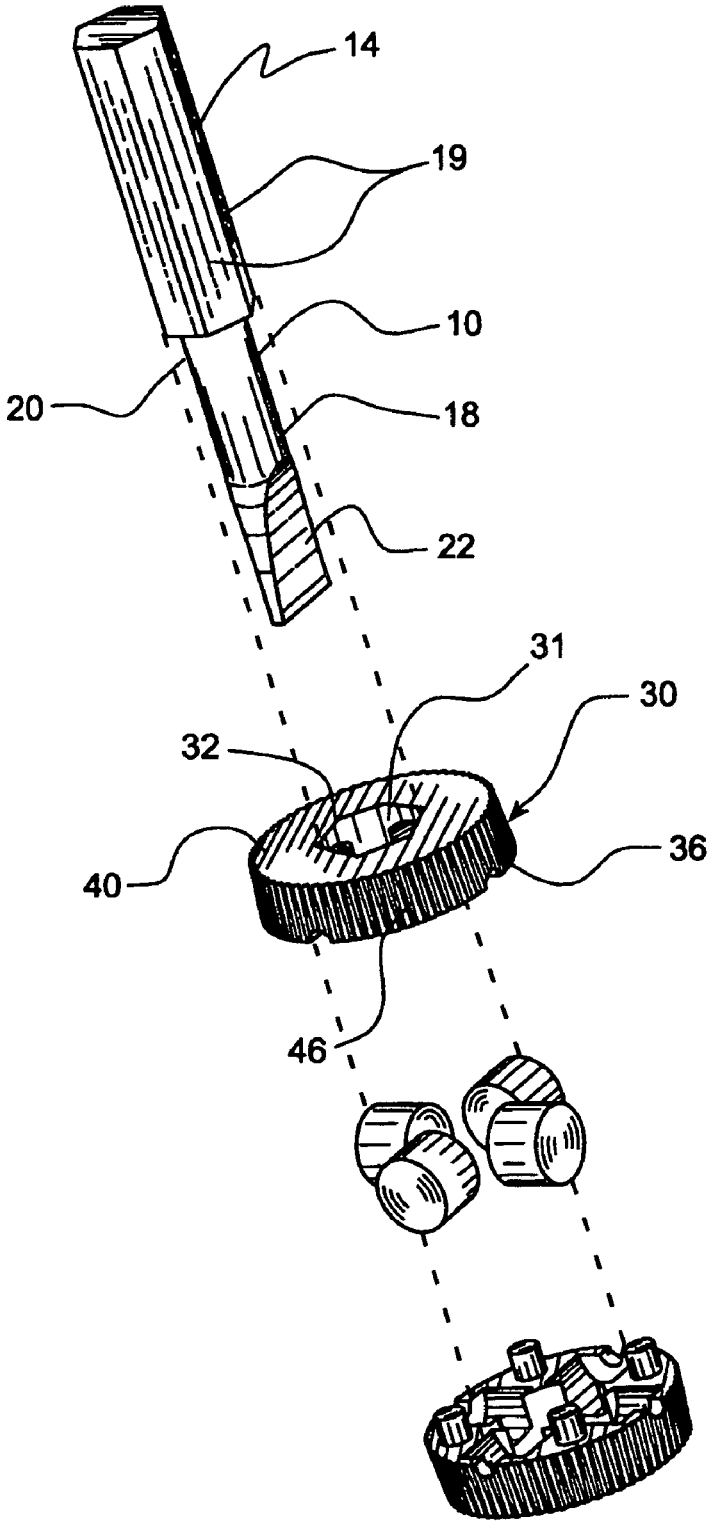
FIG. 2 is an exploded view of a magnetic bit-holding tool, in accordance with features of the present invention.
Figure 3A:
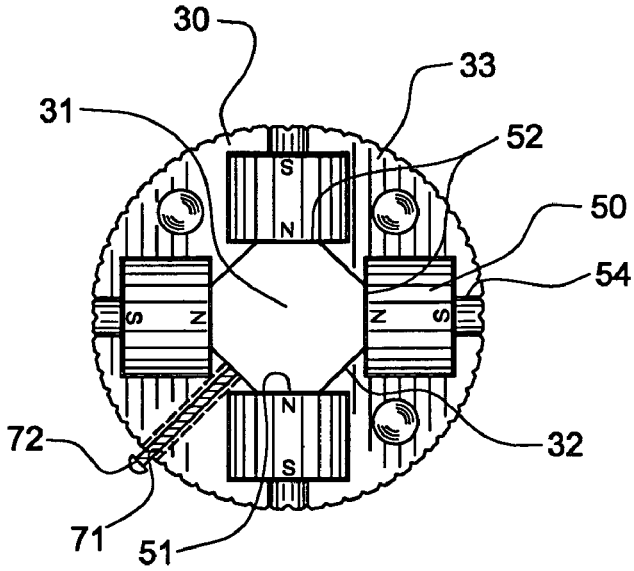
FIG. 3*a* is a cross sectional view of a magnetic bit-holding tool taken along line 3-3 of FIG. 1, in accordance with features of the present invention.
Figure 3D:
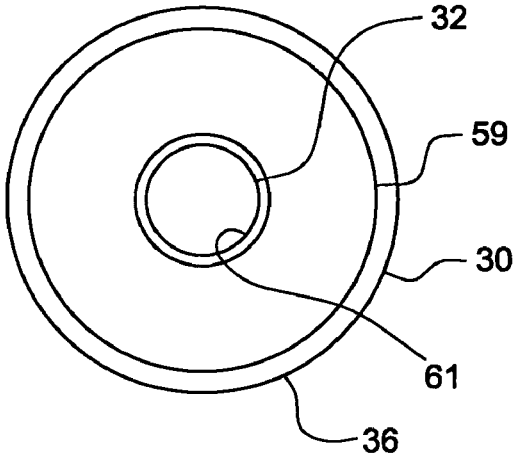
FIG. 3*d* is a cross-sectional view of a ring-magnet bit, fastener, or nut-holding tool, in accordance with features of the present invention.
Figure 3C:
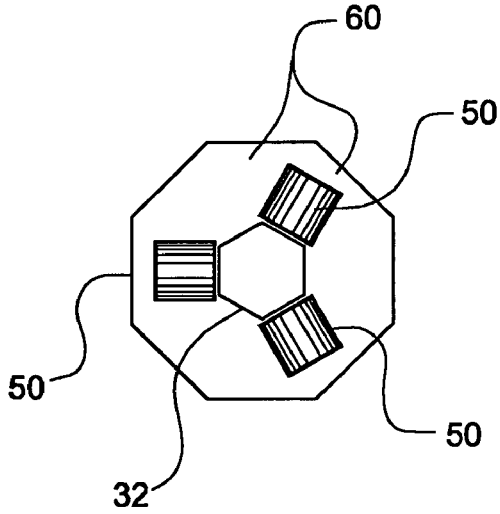
FIG. 3*c* is a cross-sectional view of a three-magnet bit, fastener, or nut-holding tool, in accordance with features of the present invention.
Figure 3B:
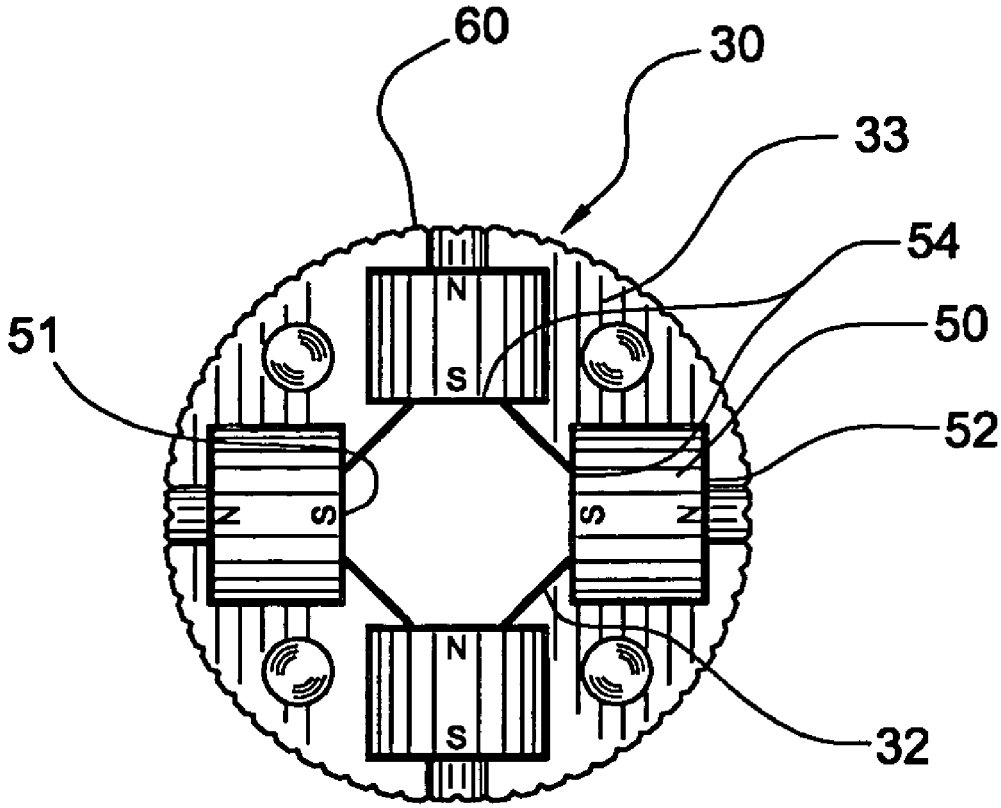
FIG. 3*b* is a cross sectional view of a magnetic bit-holding tool with another magnet configuration, in accordance with features of the present invention.

Referring to FIG. 1, an exemplary embodiment of the proposed magnetic bit-holding tool is schematically depicted as numeral 9. A magnetizable tool bit 10 is shown slidably received by the tool. While a flat-blade screw bit is shown in FIG. 1, any bit can be manipulated by the tool. A typical bit 10 comprises a head 14, a shank 18, and a driving tip 22. Most commonly available are bits containing a shank with a hexagonal cross-section. Bits with square cross-sections and other non-circular cross sections also are encountered. The present invention can accommodate all bits a driving portion of which has a non-circular cross-section. As shown in FIG. 2 and FIG. 3*c*, a hexagonal channel 31 exists in the invented device to accommodate hexagonal shaped bit stems. FIGS. 3*a*-3*b* depict an octagonal shaped cross section channel. FIG. 3*d* depicts a circular cross section channel. Generally, the only requirements are that the head 14 and/or peripheral surface 19 of the shank 18 of the bit contains a cross section in mating relationship with the cross section of the axial bore or channel 31 of the tool.

The invented tool 9 comprises a generally cylindrical-shaped housing 12. Magnets 50 are positioned symmetrically within said housing. The housing can be manufactured so as to have an upper half and lower half, the halves separable so as to facilitate insertion of the magnets.

A central region of the housing defines an aperture or tunnel 31 which extends coaxial to the axis a of the cylindrical housing, as depicted in FIG. 2. An inner periphery 32 of the bore 31 comprises a plurality of planar surfaces 40 which complement the peripheral surfaces 19 on the bit 10, thereby allowing the bit 10 to slidably communicate with the device but being prevented from rotating within the confines of the bore. This feature serves as a means for imparting rotatable torque to the fastener or bit received by the tool.

It can be appreciated from FIG. 1 that the assembly presented therein may function as a "stubby" screwdriver. To facilitate this function, circumferentially extending surfaces 36 of the tool 9 define a topography to facilitate reversible frictional engagement with a wrench, pliers, rotatable chuck, or a user's fingers. The torque thus imparted may be applied to the bit 10 at the points of contact of the bit surfaces 19 with the ring inner surfaces 40. A plurality of tools can be stacked in coaxial relation to each other forming a stack 90, thereby defining a handle reminiscent of that found on atypical stubby screw driver, the stack depicted in FIG. 4*a*. The top-most tool of the stack defines a cap 29 over its axial bore. This cap serves as an abutting substrate against which the head 14 of bit 10 may come to rest inside the extended bore created by the stacked tools. The cap can be integrally molded with the housing of the topmost tool or else in threadable communication therewith so as to be removably attached to the ring.

FIG. 2 depicts the hexagonal cross-section head 14 of the bit 10 in mating orientation with the ring 30, whereby the planar surfaces 19 on the head 14 complement match the planar surfaces 40 on the inner periphery 32 of the ring 30. The outer periphery 36 of the annulus is depicted with flutes 46 to form a knurled surface. Alternatively, the outer periphery 36 comprises planar ridges that may be easily grasped by a pair of pliers or by a person's fingers and thus facilitate the use of the bit-holding ring as a hand-held screwdriver. The cap 29 (see FIG. 1) prevents the bit from sliding out of the ring when the bit experiences a force along the axis of the bit.

Magnet Placement Detail

The housing 12 substantially envelopes bar magnets 50 (see FIGS. 2, 3*a*, and 3*b*) that at the bore 31 generate a magnetic field perpendicular to the plane defined by the ring 30. The placement of the bit 10 inside the ring 30 allows for the maximum magnetic force between the ring 30 and the bit 10. The bar magnets magnetize the bit 10 so that the tip 22 may attract and hold a ferrous fastener 24. As such, a plurality of rings can be arranged to enhance magnetic flux through the bit. The rings may contact each other, or be spaced axially along the bit in a fashion which allows for spacing between the rings.

The magnets 50 can be arranged so that an inwardly facing surface 51 of the magnets contact the object confined to the bore 31. Alternatively, the magnets can be arranged to be completely enveloped by the housing, as depicted in FIG. 3*c*.

FIG. 3*a* is a cross sectional view of a proposed magnetic bit-holding tool, and FIG. 3*b* is a cross sectional view of an alternate embodiment thereof. Depicted in FIG. 3*a* and 3*b* is the arrangement of a plurality of bar magnets 50 embedded in a non-magnetizable substrate 33 comprised in the ring 30. The arrangement in the two figures is identical except that in FIG. 3*a* (the "North Configuration") the North poles 52 of the magnets 50 are proximal to the inner periphery 32 of the ring 30 while in FIG. 3*b* ("the South Configuration") the South poles 54 are proximal to the inner periphery 32. Different colors can be used for the two different magnet configurations. The periphery 32 may be circular, or hexagonal, or of any convenient configuration. Optionally, as seen in FIG. 3*a*, the ring 30 may comprise a threaded radially extending bore 71 accommodating a set screw 72 that may be used to anchor the ring 30 to a bit inserted therein.

Figure 7:
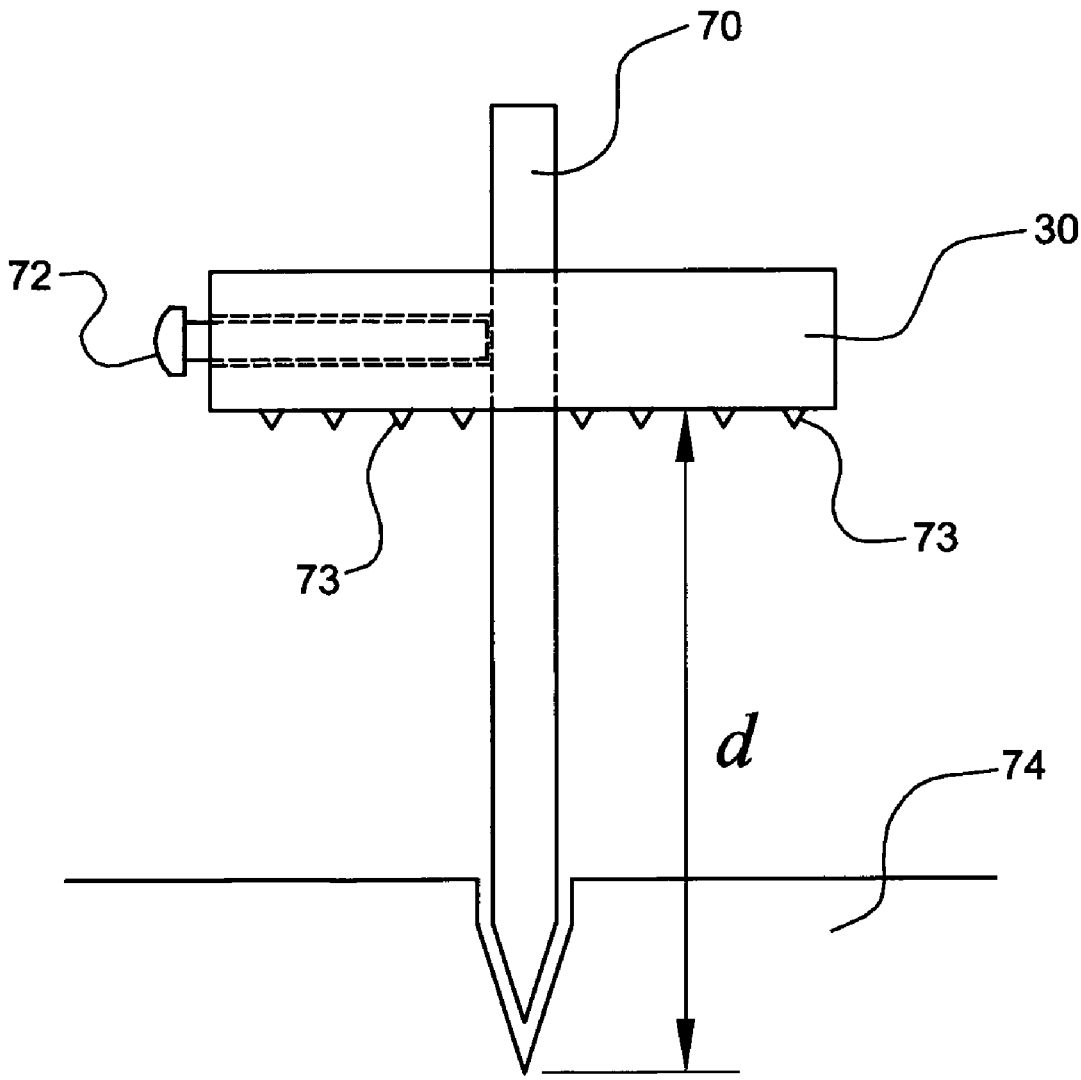
FIG. 7 is a view of an adjustable magnetic bit, fastener, or nut-holding tool used as a shavings catcher and as a drill stop, in accordance with features of the present invention.

A ring 30 with a set screw 72 has special advantages. When mounted on a drill bit 70 (see FIG. 7), its magnetism may be used to catch metal shavings 73 emanating from the workpiece 74. Also, it may be used as a stop to limit the depth d the bit may penetrate in the workpiece 74.

While four bar magnets are shown in the figure, one may use an arbitrary number of magnets. Best results are obtained with a magnet arrangement that possesses azimuthal symmetry around the bore 31. Thus, three magnets at 120 degrees to each other with each magnet abutting a surface 40 on the periphery 32 of the ring 30 is particularly advantageous for a ring 30 where the inner periphery 32 has a hexagonal cross-section (See detail in FIG. 3*c*). As noted supra, the magnets can be arranged so as to physically contact the bit positioned in the bore. Alternatively, the magnets can be completely encapsulated in the annulus housing so as to prevent direct contact between the bit and the magnets, thereby providing a means for electrically isolating the housing from the bit or shank it encircles. In general, however, the closer the magnetic poles are to the inner periphery 32, the stronger the magnetic force between the ring 30 and the bit 10.

Instead of using bar magnets embedded in the ring 30, and as depicted in FIG. 3*d*, one may use a ring magnet 59, such as those supplied by National Imports LLC, Falls Church, Va. As with the bar magnets discussed above, the ring magnet can be completely enveloped by the housing. Alternatively, an inner annular surface 61 of the magnet can be exposed via aperatures in the periphery 32 of the control channel 31.

Figure 6:
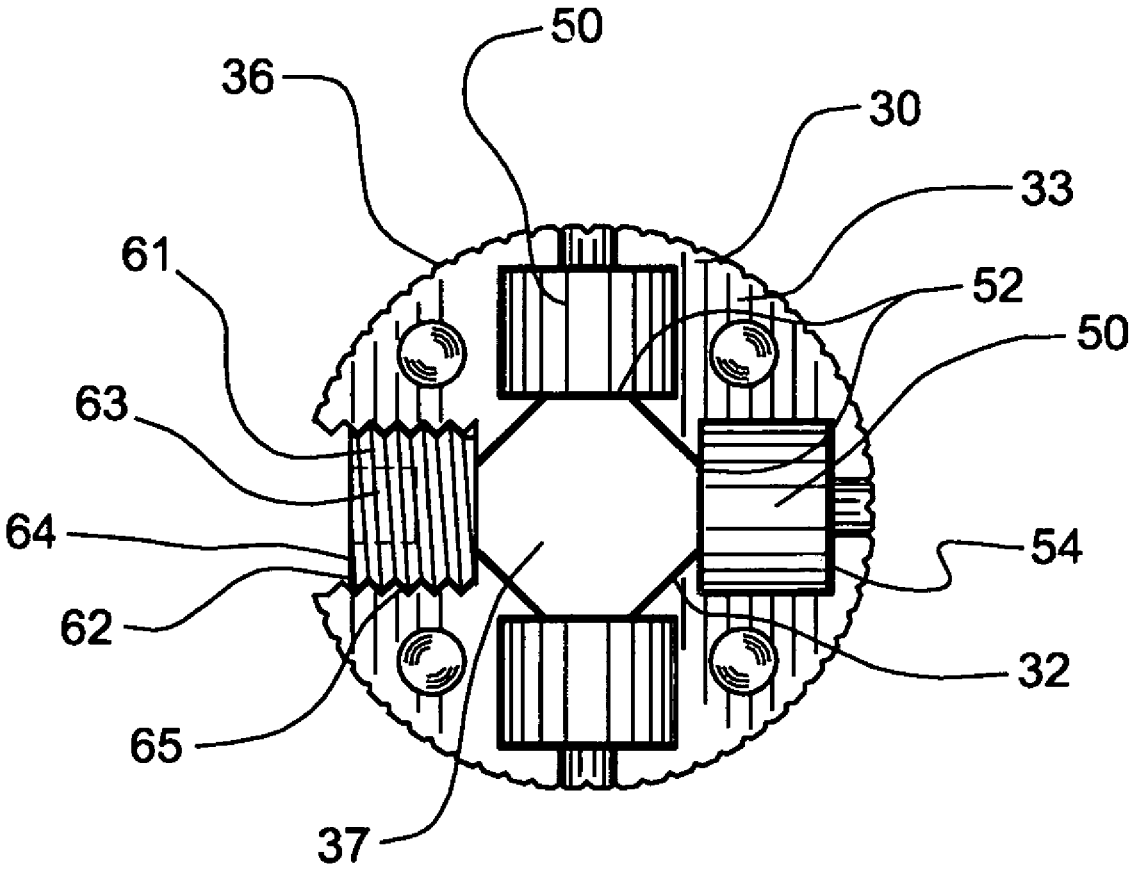
FIG. 6 is a cross sectional view of an adjustable magnetic bit, fastener, or nut-holding tool, in accordance with features of the present invention.

FIG. 6 is a cross sectional view of an alternative embodiment of a proposed magnetic bit-holding tool wherein the position of one or more of the magnets is adjustable, thus allowing one to modify the force with which an object is held in the ring. Depicted in FIG. 6 is an arrangement of a plurality of bar magnets held in a non-magnetizable substrate 33 comprised in the ring 30, wherein one or more of magnets 61 comprise a threaded surface 62 on its periphery. An outwardly facing (i.e. radially directed) of the threaded magnet defines a cavity 63 adapted to receive a bit (i.e. flat blade, Allen™, Philips™., etc. . . . ). The threaded magnets 61 are held in radial bores 65 threaded so as to matingly receive the magnets 50. This allows the position of the magnets to be adjusted by advancing or retreating their positions within the bores 65. The threaded magnet 61 can serve as a set screw to anchor the ring 30 to a shank inserted in the cavity 37.

While the above discussion suggests that the magnets be embedded in the ring, this is not necessary. They can be attached above or below the plane of the ring. The latter configuration allows for easier substitution of magnets.

Figure 4A:
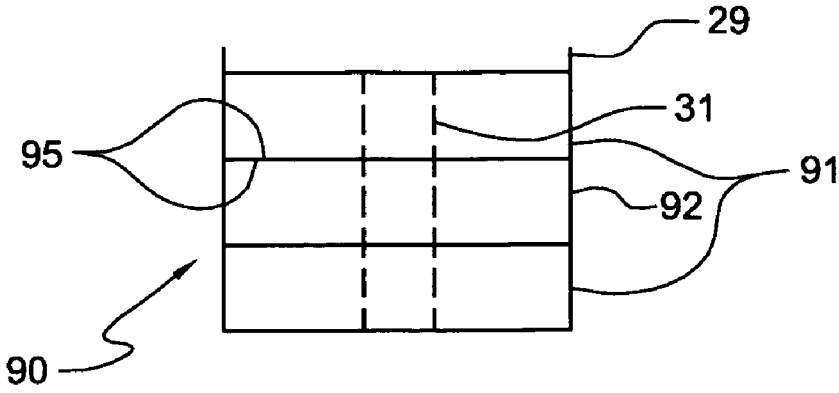
FIG. 4*a* is an elevational view of a stack of magnetic bit, fastener, or nut-holding devices, in accordance with features of the present invention.
Figure 4B:
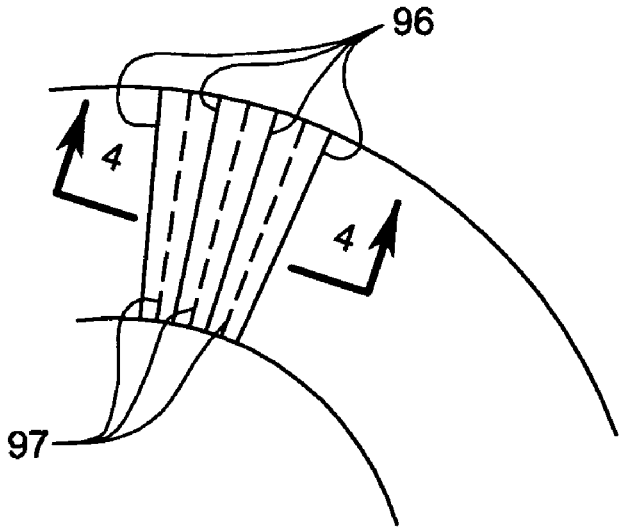
FIG. 4*b* is a detail view of a magnetic bit, fastener, or nut-holding tool, in accordance with features of the present invention.
Figure 4C:
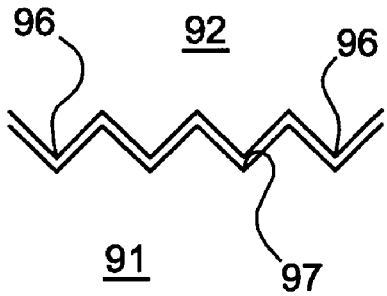
FIG. 4*c* is a view of FIG. 4*b* taken along line 4-4, in accordance with features of the present invention.

As shown in FIG. 4*a* one may make a stack 90 of two or more compatible magnetic rings in order to obtain a combination bit-holder/screwdriver possessing a greater magnetic force and allowing the application of a larger mechanical torque on the bit 10. The rings must be stacked coaxially with adjacent rings having opposite magnetic polarities. Thus rings 91 have a North configuration and 92 has a South configuration. Relative slippage of the rings may be prevented by providing closely spaced radial indentations on the faces 95 of the rings. See the details in FIG. 4*b* where solid lines 96 indicate protrusions from the face 95 and dotted lines 97 indicate furrows therein. FIG. 4*c* shows how the protrusions 96 in a depending face of a superior ring 92 mate with the furrows 97 found on an upwardly facing surface of an adjacent ring which is in close spatial relation to the ring containing the protrusions.

Also shown in FIG. 4*a* is a ring 91 where the central bore 31 is not a through bore but terminates instead in a cap 29. The cap 29 may be cemented or otherwise attached to the ring or it may be integrally molded to the ring. The cap facilitates the use of the invented ring as a screwdriver.

Operation of the invention as a screwdriver is straightforward and often one may find that a ring with a cap is best suited for use as a screwdriver. A bit with a cross-section matching the inner periphery of the ring is inserted head first in the bore and the invention is ready for use with either a manual torque or a tool-provided one. The magnetic attraction between the ring and the bit allows for a very quick insertion of the bit into the bore. In fact all one need do is bring the bit's head near the ring's inner periphery and the bit snaps into place thereby facilitating one-hand operation. This is far superior to the ball/detent or friction fit systems often used to hold bits. Furthermore, the present invention may be used in conjunction with a screwdriver. One may drive a bit with a bit-holding screwdriver while the magnetic ring is positioned around the shank of the bit.

The proposed bit-holder device can also be used as a fastener driver. This is most straightforwardly so where the fastener is ferrous and has a head with a non-circular cross-section. Of course, the device can exert torque on any fastener with a non-circular cross-section. Further, as shown in FIG. 1, the cap 29 of the device may comprise a protrusion 88 that is configured to match a cavity at the head of the fastener (Allen, Phillips, Tor-x, straight blade, etc. . . . ).

Figure 5:
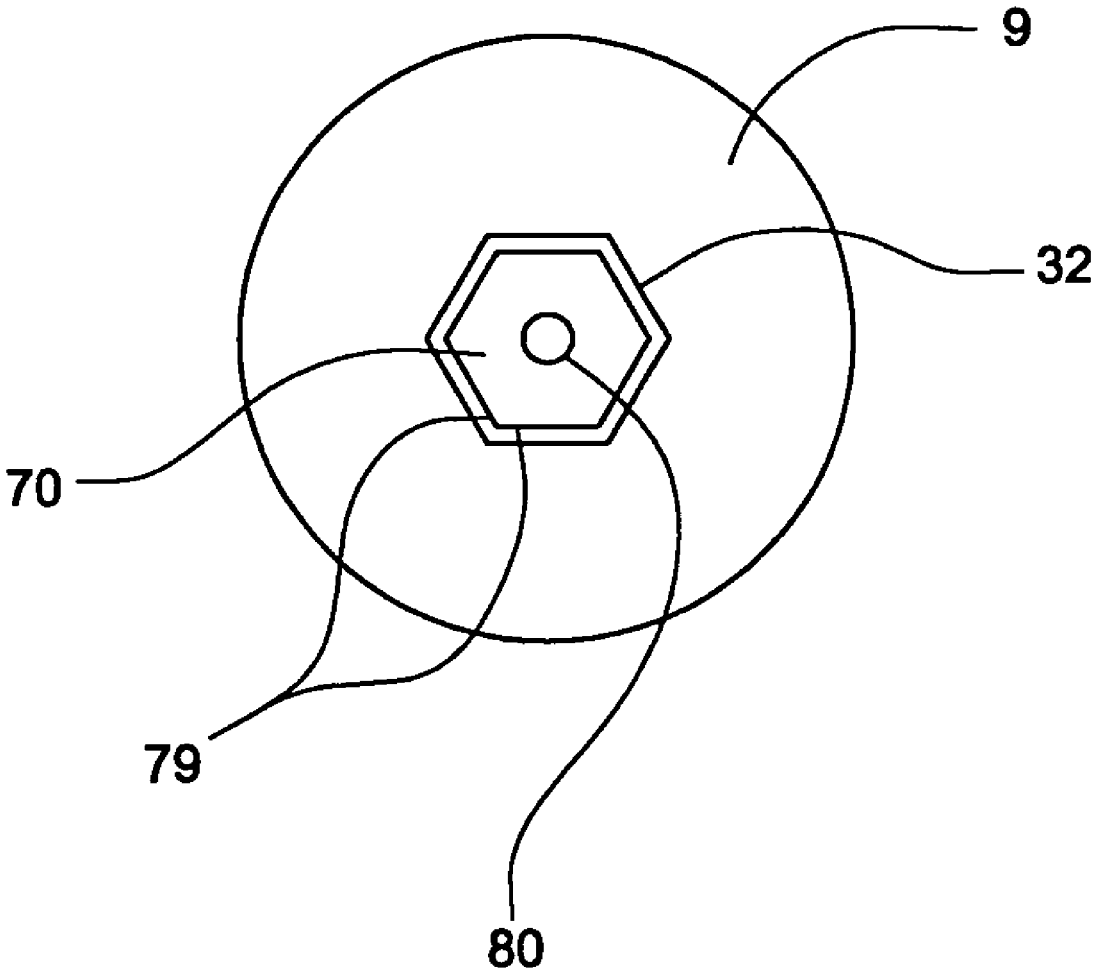
FIG. 5 is a planar view of a magnetic bit-holding tool being used as a nut-holding tool, in accordance with features of the present invention.

Without any modifications, the proposed bit-holder can also be used most readily as a nut holder and nut driver for threaded nuts whose outer periphery matches the inner periphery 32 of the ring. This is depicted in FIG. 5 where a magnetizable hexagonal nut 70 with an hexagonal outer periphery comprising planar surfaces 79 and a threaded bore 80 is slidably received within the inner periphery 32 of the ring 30. The bore is depicted extending in a direction opposite from the inner cavity formed by the bore. The magnetic field generated by the ring 30 serves to keep the nut 70 confined to the plane defined by the ring 30. The magnetic holding feature is particularly advantageous when the device is used as either a fastener or nut driver. The fastener or nut being driven is held firmly in place until its thread engages a corresponding thread. Then the nut or fastener can be rotated as firmly as desired while it slides smoothly along the axis of the thread.

Furthermore, as shown in FIG. 1, the cap 29 may comprise a shank 88 allowing the device to be engaged by the chuck of a power tool.

Referring to FIG. 2, fabrication of the magnetic rings is straightforward. A myriad of materials may be employed for the substrate 33 into which the bar magnets 50 are embedded. Non magnetizable materials, such as plastics, aluminum, wood, etc. . . . , are especially suitable. For the bar magnets themselves, one may use commercially available neodymium magnets.

In brief, a tool for holding and driving tool bits and nuts is disclosed, said tool comprising one or more magnetic annuluses with an inner periphery that matches the cross section of the bit or nut.

While the invention has been described in the foregoing with reference to details of the illustrated embodiment, these details are not intended to limit the scope of the invention as defined in the appended claims.

The embodiment of the invention in which an exclusive property or privilege is claimed is defined as follows:

1. A device for slidably holding and manipulating a bit having a predetermined cross-section, the device comprising:

a plurality of annuluses removably stacked on top of each other, wherein each of said annuluses have a first face and a second face and where each of said faces further comprise a means for interlocking the annuluses so that they be held in close spatial relation and each said annuluses comprising;

a) an inner periphery adapted to engage with a complementary geometry of the cross section of the bit;

b) an outer periphery adapted for rotating the annulus; and c) a means to magnetically hold the bit and to attract a fastener to an end of the bit.

2. The device as recited in claim 1 further comprising a first end and a second end and a central aperture defined by the inner periphery and extending from the first end to the second end.

3. The device as recited in claim 2 wherein said magnetic holding means comprises one or more ring magnets.

4. The device as recited in claim 2 wherein the central aperture has a longitudinal axis and wherein said magnetic holding means comprises bar magnets oriented perpendicular to said axis.

5. The device as recited in claim 1 wherein an annulus from the plurality of annuluses has a threaded radial bore dimensioned to receive a set screw.

6. The device as recited in claim 1 wherein the outer periphery comprises a plurality of flutes.

7. The device as recited in claim 1 wherein the outer periphery comprises a plurality of planar ridges.

8. The device as recited in claim 1 wherein an annulus from the plurality of annuluses comprises a cap.

* * * * *